US006373922B1

(12) United States Patent
Dalpe et al.

(10) Patent No.: US 6,373,922 B1
(45) Date of Patent: Apr. 16, 2002

(54) METHOD AND APPARATUS FOR FILAMENT SET HEIGHT ADJUSTMENT OF A CATHODE CUP ASSEMBLY

(75) Inventors: Dennis Joseph Dalpe, Schenectady; Elena Rozier Gearing, Clifton Park; Don Mark Lipkin, Niskayuna, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/574,043

(22) Filed: May 18, 2000

(51) Int. Cl.[7] ..... H01J 35/06

(52) U.S. Cl. ..... 378/136; 378/205; 378/207; 445/28

(58) Field of Search ..... 378/136, 119, 378/135, 134, 122, 207, 205; 313/237; 445/28

(56) References Cited

U.S. PATENT DOCUMENTS 4,338,542 A * 7/1982 Takanashi et al. ..... 313/446
5,526,396 A 6/1996 Jacob ..... 378/136
5,920,605 A 7/1999 Lu ..... 378/136

* cited by examiner

*Primary Examiner*—Drew Dunn
(74) *Attorney, Agent, or Firm*—Paul J. DiConza; Donald S. Ingraham

(57) ABSTRACT

A method and apparatus are provided for adjusting a filament set height in a cathode of an x-ray tube. The method for adjusting a filament set height of a cathode comprises providing a cathode cup of an x-ray tube, the cathode cup comprising at least one bore extending therethrough; inserting a filament post through at least one bore such that the filament set height is below a desired filament set height; measuring an actual filament set height that results from the step of inserting; determining a filament set height adjustment distance in which the filament set height adjustment is generally equal to a difference between the actual filament set height and the desired filament set height; contacting an end of the filament lead with an adjustment tool; and moving the adjustment tool a distance substantially equal to the filament set height adjustment distance. Therefore, the filament is positioned at the predetermined filament set height.

22 Claims, 8 Drawing Sheets

METHOD AND APPARATUS FOR FILAMENT SET HEIGHT ADJUSTMENT OF A CATHODE CUP ASSEMBLY

BACKGROUND OF THE INVENTION

The invention relates to x-ray tubes used in medical imaging. In particular, the invention relates to a method and apparatus for adjusting a filament set height in a cathode cup assembly for an x-ray tube.

An x-ray source is often used in medical imaging systems, such as, but not limited to, computed tomography, fluoroscopy and mammography systems. The x-ray source typically includes an evacuated vessel, known as the frame, containing an anode and a cathode. X-rays are produced by applying a high voltage across the anode and cathode, and accelerating electrons from the cathode toward a focal track on the anode.

Known cathode assemblies for such x-ray sources typically include a cathode cup and a plurality of current carrying filaments. The filament leads extend through the cup via the filament feed-through assembly, which typically comprises an electrical insulator and a metallic sleeve used for securing the leads at the desired location.

At least one known filament geed-through assembly includes a tubular filament post, a substantially cylindrical insulator, and a sleeve. The filament post may be positioned within the sleeve. Precise positioning of the filaments with respect to the cathode cup is important because the positioning affects operational characteristics of the x-ray tube, such as the focal spot size and position and the emission current. Accordingly, it is desirable to properly position the filament leads and thus the filament within the cathode cup.

Conventional filament setting methods for adjusting the filament set height may use pliers and a hammer to pull, twist, or push the filament lead to its desired location. The extent of lead movement is difficult to control, and the desired filament alignment is attained by iteratively adjusting and measuring the filament position, until the filament set height is within a desired tolerance. This process is time-consuming and requires multiple steps to position the filament within the desired filament set height tolerance and may result in damage to the filament assembly.

Accordingly, a need exists to enhance the filament setting operations. In particular, a need exists for adjusting filament positions in cathodes and similar devices.

SUMMARY OF THE INVENTION

An aspect of the invention provides a method for adjusting a filament set height in a cathode of an x-ray tube. The method for adjusting a filament set height in a cathode comprises providing a cathode cup of an x-ray tube, the cathode cup comprising at least two feed-throughs extending therethrough; inserting a filament lead through the at least two feedthroughs to a filament set height below a desired filament set height; measuring an actual filament set height that results from the step of inserting; comparing actual filament set height that results from the step of inserting to the desired filament set height; determining an adjustment to the filament set height in which the adjustment is generally equal to a difference between the actual filament set height and the desired filament set height; contacting an end of the filament post with an adjustment tool; and moving the adjustment tool a distance substantially equal to said adjustment filament set height distance. Therefore, the filament is positioned at the predetermined filament set height.

A further aspect of the invention provides a device for adjusting a filament set height of a filament in a cathode. The device comprises a fixture comprising a central bore having a first open end and a second open end; an axial calibrator received in the first open end of the fixture and disposed relative to the second open end; and a clamp adjacent the second open end for securing the fixture to a portion of the cathode such that a filament post extends through the second opened end and is capable of being moved along its axis. The calibrator is capable of being brought into contact with an end of the filament lead.

Another aspect of the invention sets forth an adjustment apparatus for adjusting an x-ray tube filament. The adjustment apparatus comprises a fixture, a central bore having a first open end and a second open end; a micrometer received in the first open end of the fixture and disposed relative to the second open end; and a clamp adjacent the second open end for securing the fixture to a portion of the cathode such that a filament lead of the filament extends through the second opened end. The micrometer is capable of being brought into contact with an end of the filament post and adjusting the position of the filament post so as to affect the filament set height.

DETAILED DESCRIPTION OF THE INVENTION

Figure 1:
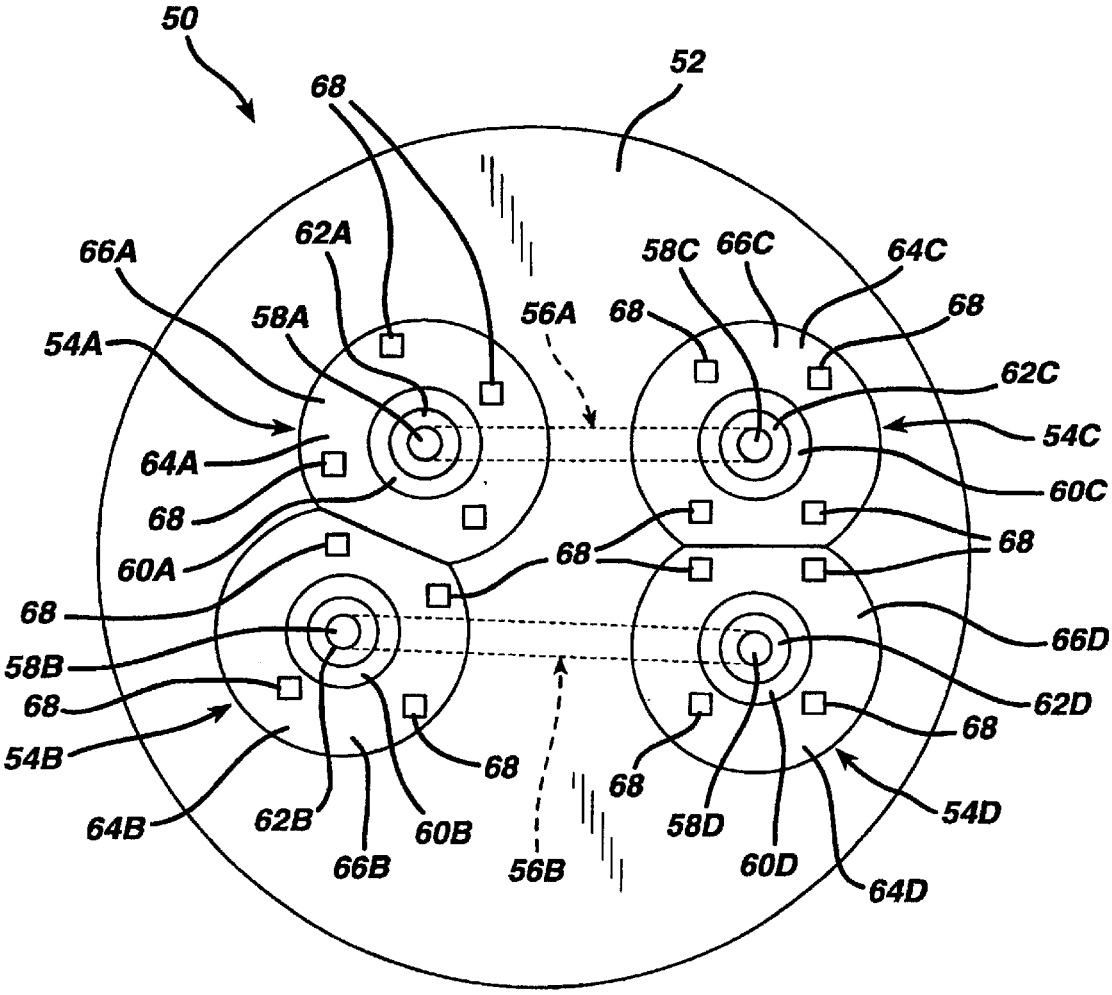
FIG. 1 PRIOR ART
FIG. 1 is an illustration of a filament insulator and cathode cup.
Figure 2:
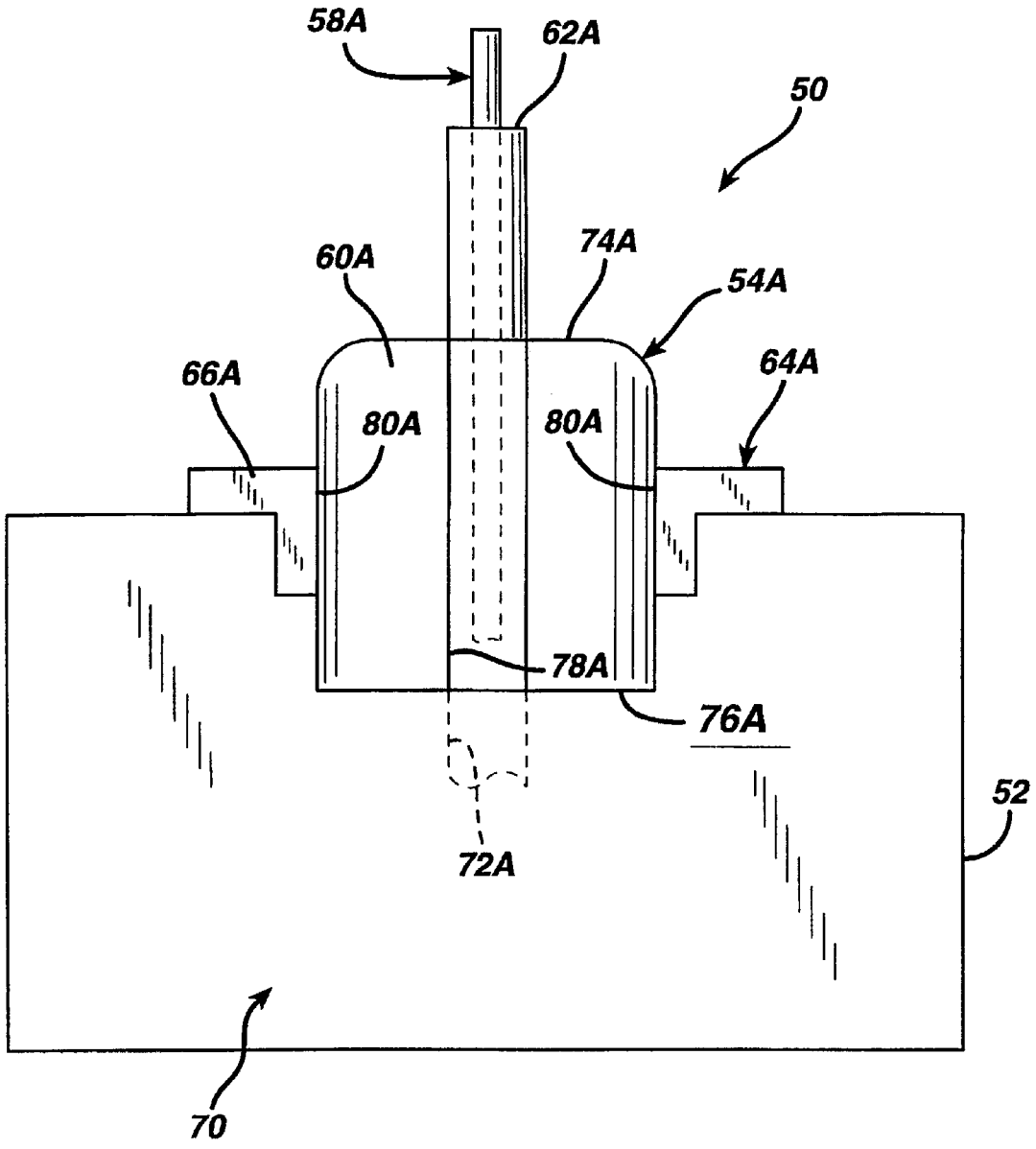
FIG. 2 PRIOR ART
FIG. 2 is a side elevation partial cross-section illustration of the filament insulator and cathode cup of FIG. 1.

FIG. 1 is a plan illustration of a known cathode cup assembly 50 to which the present invention may be readily adapted for use. The cathode cup assembly 50 comprises a cathode cup 52, four filament insulators 54A, 54B, 54C, and 54D and two filament assemblies 56A, 56B (illustrated in phantom). The filament assemblies 56A, 56B each include a filament (not illustrated) and posts 58A, 58B, 58C, and 58D that extend from respective ends of the filaments. The filament insulators 54A, 54B, 54C, and 54D each comprise a respective insulating member 60A, 60B, 60C, and 60D, a respective post sleeve 62A, 62B, 62C, and 62D, and a respective flange 64A, 64B, 64C, and 64D. The insulating members 60A, 60B, 60C, and 60D each can comprise a bore therein (not illustrated in FIG. 1), and filament lead tubes 62A, 62B, 62C, and 62D that are inserted within the respective bores. The filament lead tubes 62A, 62B, 62C, and 62D can be brazed to respective insulating members 60A, 60B, 60C, and 60D. NEED?

Each flange 64A, 64B, 64C, and 64D comprises an aperture (not illustrated) sized so that the respective insulating members 60A, 60B, 60C, and 60D can extend therethrough. The flanges 64A, 64B, 64C, and 64D can be brazed to respective insulating members 60A, 60B, 60C, and 60D so that each flange portion 66A, 66B, 66C, and 66D extends radially outwardly from respective insulating members 60A, 60B, 60C, and 60D. The flanges 64A, 64B, 64C, and 64D can be welded, for example spot welded, to cathode cup 52 at weld 68 to secure cathode insulator 54A, 54B, 54C, and 54D to cathode cup 52. Prior to welding, however, the flanges 64A, 64B, 64C, and 64D should be trimmed so that the flanges 64A, 64B, 64C, and 64D do not overlap. If such flanges 64A, 64B, 64C, and 64D were to overlap, then it would be very difficult to securely weld each flange 64A, 64B, 64C, and 64D to the cathode cup 52. The following description may refer to the welding as spot welding, however, this description is merely exemplary and is not intended to limit the invention in any manner.

Filament 56A can be inserted in cathode cup 52, so that the filament rests within a filament receiving portion 70 of the cathode cup 52. The filament post 58A can extend through a filament feedthrough assembly comprising an insulating member 74A, and the filament feedthrough sleeve 62A. The filament post 58A extends from the filament feedthrough sleeve 62A. The distance from a specified cathode cup surface to the emitting portion of the filament is also referred to herein as a "filament set height".

The filament post 58A can then be connected to the filament feedthrough sleeve 62A. A similar process is carried out for the remaining filament posts 58B, 58C, and 58D. It should be appreciated that the aforementioned cathode cup arrangement is merely exemplary of the invention, and may be readily adapted to numerous other types and styles of cathode cup arrangements.

filaments need to be adjusted to prescribed set height tolerances, for example, but not limited to, about 20 microns. Previously, filament set heights were adjusted using pliers to pull the filament posts to decrease the set height or using a hammer to push the post through the filament feedthrough sleeve in order to increase the set height. Therefore, the set height adjustment distance was an estimation and several iterations were generally required before a desired filament set height was achieved.

Figure 3:
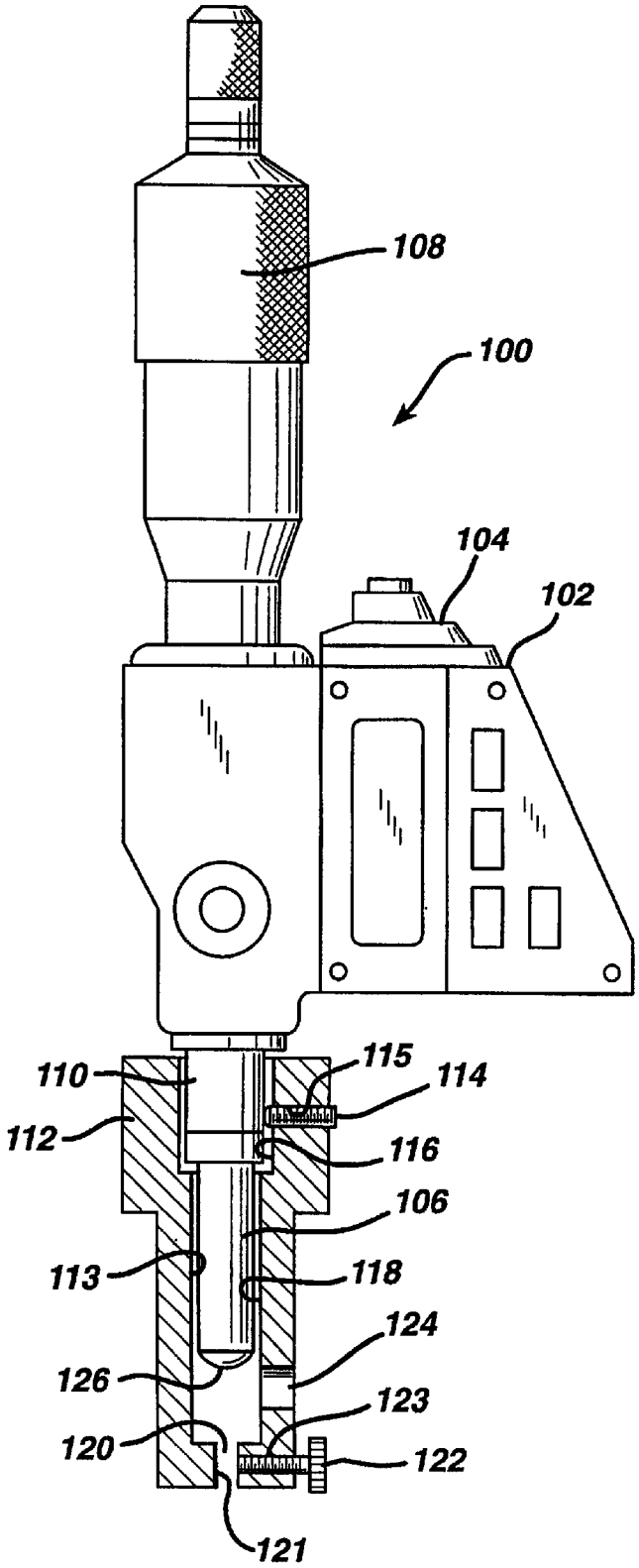
FIG. 3 is an illustration of a device for filament set height adjustment in a cathode cup assembly, as embodied by the invention.

An apparatus for filament set height adjustment, as embodied by the invention, is illustrated in FIG. 3. The apparatus (referred to hereinafter as a "filament adjustment tool") 100 comprises a calibrator, such as micrometer 102. The following description will refer to the calibrator as a micrometer; however, this is merely exemplary and is not intended to limit the invention. The digital micrometer illustrated in FIG. 3, which satisfactorily performs the process, as embodied by the invention, is manufactured by Mitutoyo Corporation of Kawasaki, Japan Model No. 350-714-30.

Figure 8:
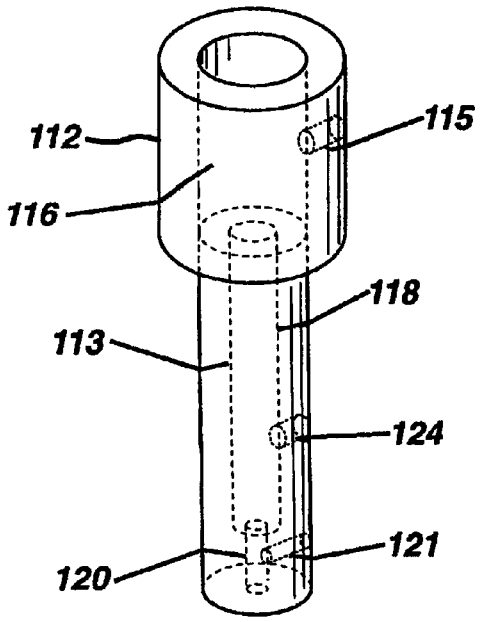
FIG. 8 is an illustration of a fixture used in FIGS. 3–7.

The micrometer 102 includes a measuring range of up to about 25 mm and can read distances to a precision of approximately 1 micron. The micrometer 102 comprises an axial pushrod 106, which is moveable, for example, by rotation of a spindle 108. An adjustment fixture 112 is secured to a housing 110 of the micrometer 102. This fixture 112 is illustrated in FIG. 8. The adjustment fixture 112 is secured relative to the housing 110 by way of a set screw 114 received in a bore 115 of the adjustment fixture 112. The adjustment fixture 112 includes a bore 113 extending through a central region of the adjustment fixture 112, with the bore 113 comprising a first section 116 having a first diameter 117. The first section 116 may accommodate the housing 110 of the micrometer 102; a second section 118 having a second diameter 119, which is less than the first diameter 117, for accommodating axial movement of the rod 106; and a third section 120 having a third diameter 121 for accommodating a filament lead tube of a cathode cup. The third diameter 121 is less than that of the second diameter 119. A set screw 122 received in bore 123 for fixedly securing the adjustment fixture 112 relative to the filament lead tube of the cathode cup, extends into the third section 120.

View 124 is provided along the length of the adjustment fixture 112. The adjustment fixture 112 may take on a number of possible configurations. For example, the adjustment fixture 112 may have an axial slot to facilitate the viewing of the contact point between the pushrod 106 and the filament post. The pushrod 106 may have rounded tip or a spherical insert 126 in order to reduce friction between the pushrod 106 and filament post. The adjustment fixture 112 may be made of any suitable rigid material, such as, but not limited to, steel or aluminum.

Figure 4:
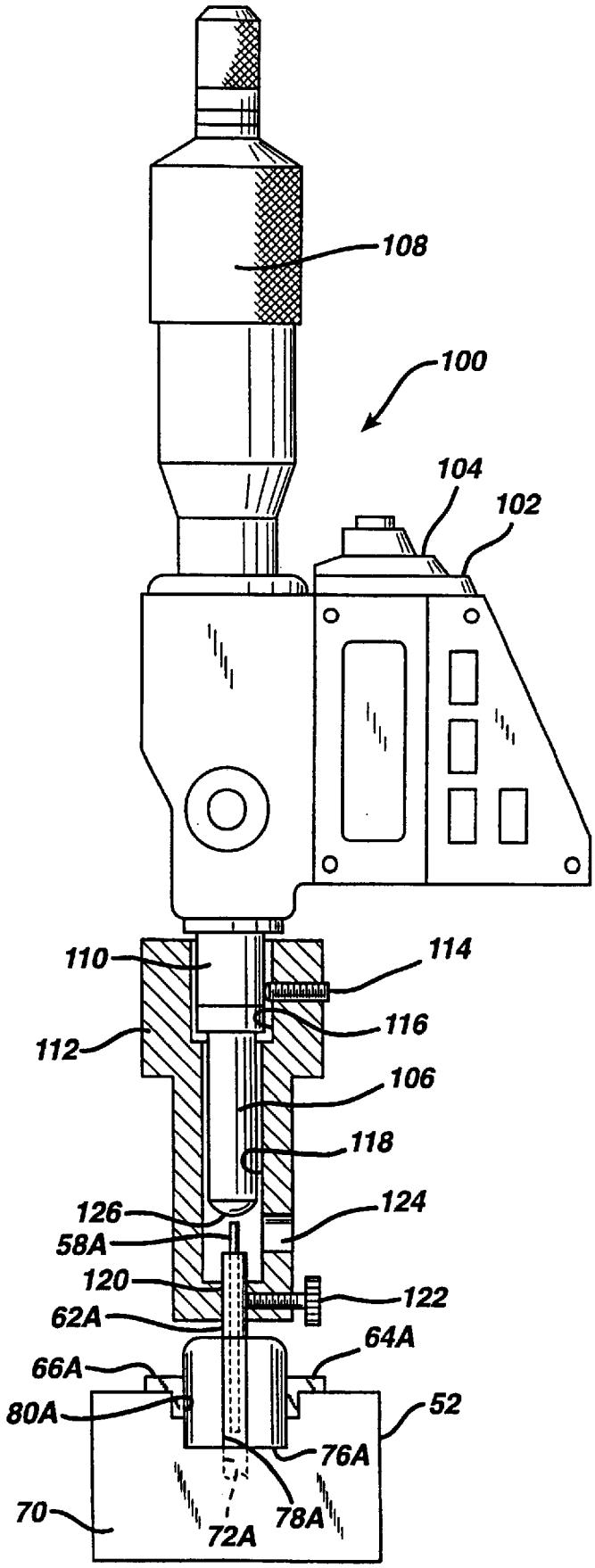
FIG. 4 is an illustration of the device of FIG. 3 used in connection with the filament insulator and cathode cup of FIG. 2.

The adjustment fixture 112 (FIG. 4) can readily receive the filament feedthrough sleeve 62A of the cathode cup 52 through a central bore 113. The adjustment fixture 112 can be secured to the filament lead tube 62A using a set screw 122 or any equivalent securing device. The filament post 58A is inserted through the filament feedthrough sleeve 62A to an initial location, such that the filament set height is below the desired value. The filament feedthrough sleeve 62A and filament post 58A can then be lightly crimped to temporarily hold the filament post 58A in place with respect to the cup 52. Because the filament post 58A is located such that it extends a greater distance through the filament feedthrough sleeve 62A than needed for the desired filament set height, the filament post 58A needs to be pushed along its axis to achieve the desired filament set height.

Figure 5:
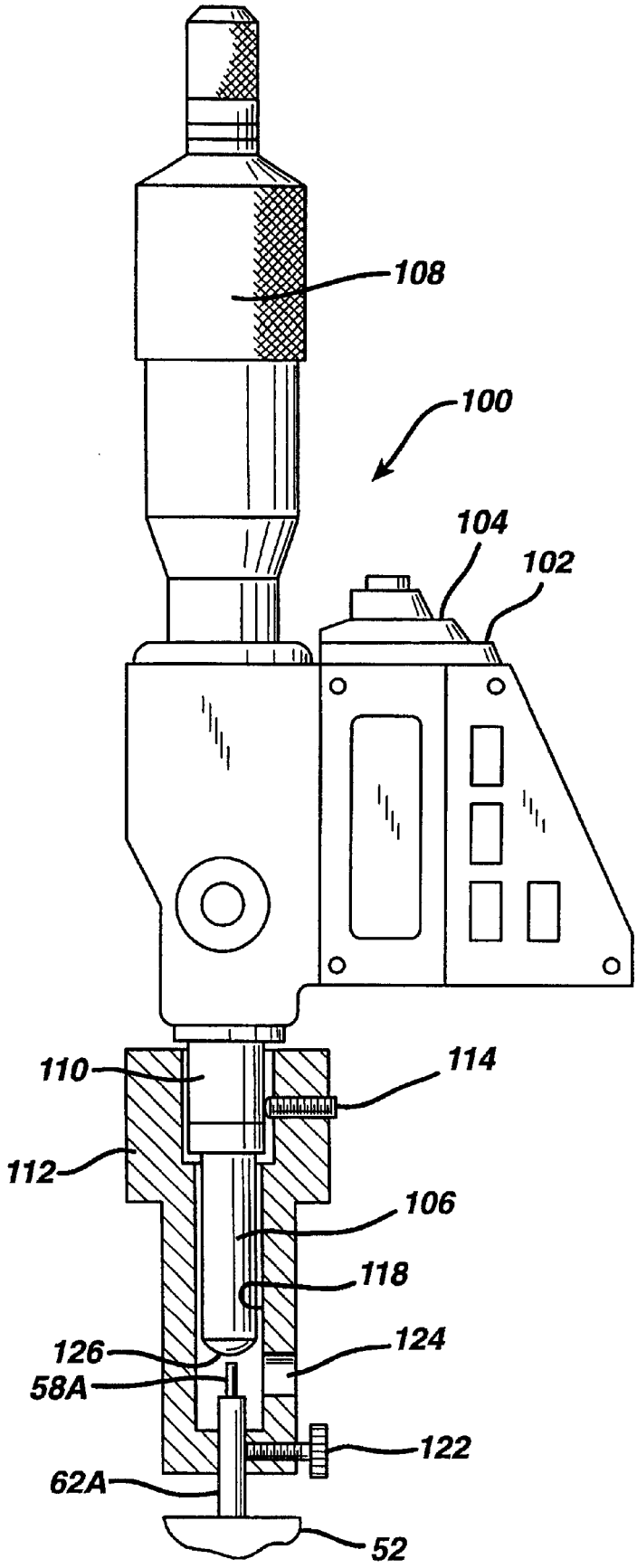
FIGS. 5–7 are sequential illustrations of a method for filament set height adjustment of a cathode cup assembly, as embodied by the invention.

Once each of the filament leads is inserted into its respective filament feedthrough sleeve and secured using a light crimp, the filament set height is measured. For example, the cup 52 is placed under a microscope, which comprises a digital height read-out. The difference between the actual set height and the desired set height is determined for each filament lead. The cup 52 may be removed from the microscope and the adjustment tool 100 can then be clamped to a respective filament lead tube, as discussed herein with respect to FIG. 4 and as illustrated in FIG. 5. Each of the filament leads can then be individually adjusted to obtain the desired set height.

Figure 6:
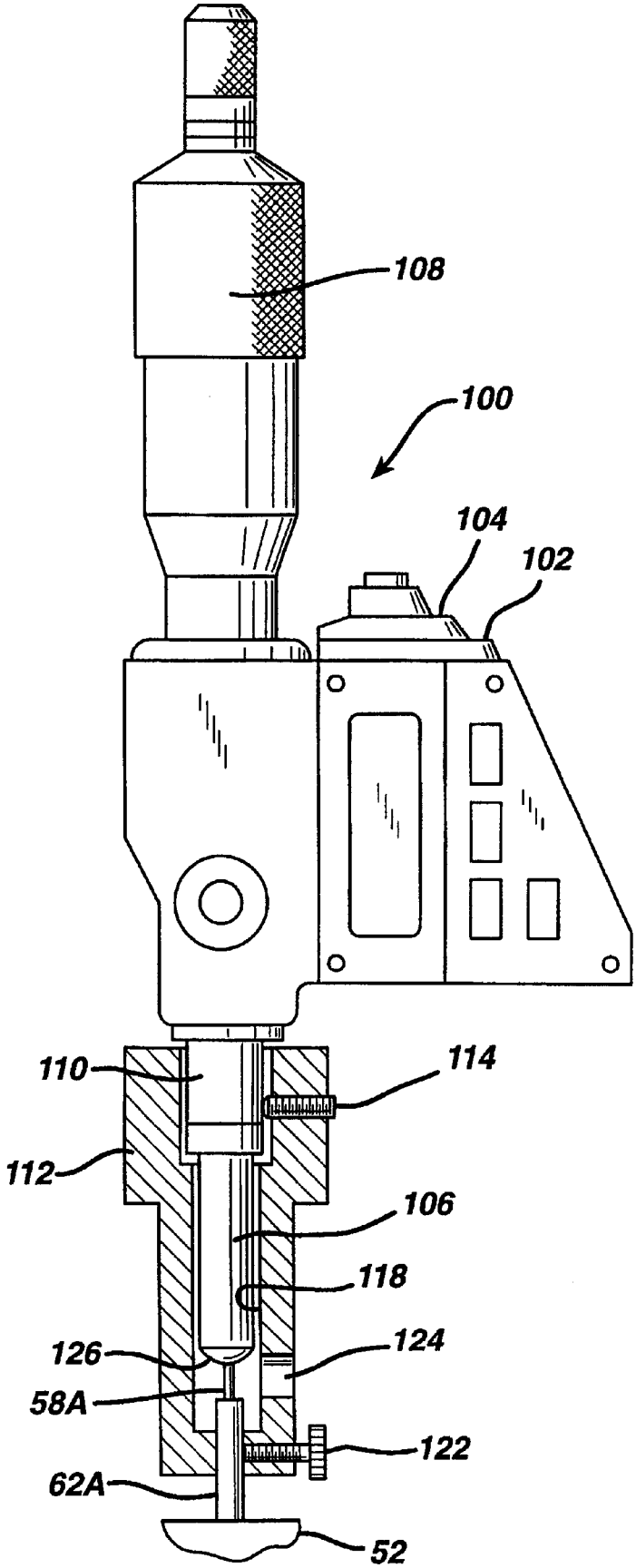
Figure 7:
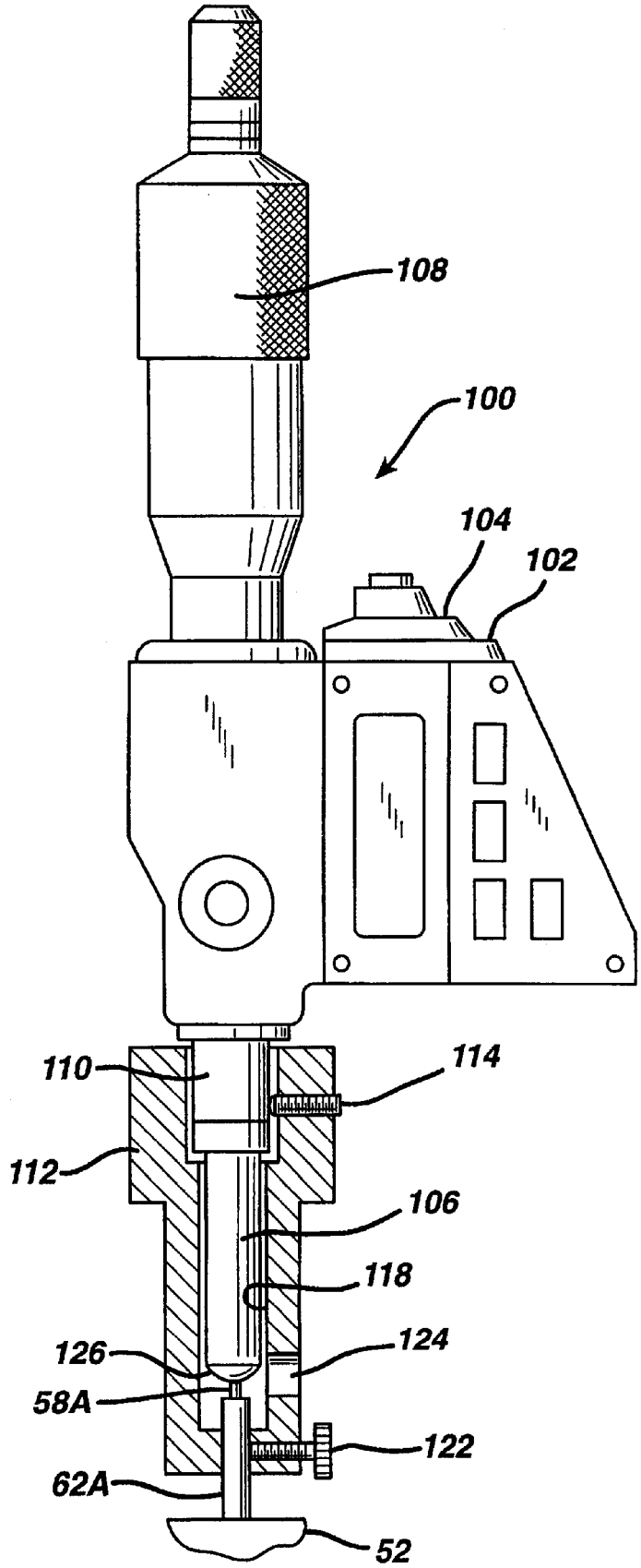

Once the filament set height adjustment tool 100 has been secured to the filament lead tube 62A, the spindle 108 of the micrometer 102 is rotated until the tip 126 of the pushrod 106 contacts the filament lead 58A, as illustrated in FIG. 6. Initial contact of the rod 106 with the filament lead 58A and movement of the filament lead 58A after contact can be inspected and visualized through the view 124 in the adjustment fixture 112. Once the pushrod 106 contacts the filament lead 58A, the read-out 104 of the micrometer 102 is noted. The spindle 108 of the micrometer 102 can then be rotated to push the filament lead 58A toward the cathode cup 52. This pushing increases the filament set height until the desired distance is reached to provide a desired filament set height, as illustrated in FIG. 7, as is readily determined by the read-out 104 of the micrometer 102.

The distance by which the pushrod 106 is moved after contact with the filament lead 58A is essentially equal to the respective set height difference previously determined. Once the desired filament set height is achieved, the filament set height adjustment tool 100 is removed from the filament lead tube 62A, for example by loosening of the set screw 122. The above process may be carried out for each of the filament leads in a cathode cup. Further, the process may be carried out on any cathode cup having a filament post Additionally, the adjustment fixture 112 may be configured so a plurality of filament leads may be adjusted simultaneously, to further reduce time associated with such an adjustment process.

FIG. 8 illustrates the adjustment fixture 112, which is utilized to fix the relative position of the micrometer 102 with respect to the filament post of the cathode cup. The adjustment fixture 112 may be made of any suitable rigid material, including but not limited to steel, aluminum, or machinable ceramic. The adjustment fixture 112 includes the central bore 113 extending therethrough and comprises the first section 116, second section 118, and third section 120. The first section 116 can receive the micrometer 102 and the third section 120 can receive the at least one of filament feedthrough sleeve and post of the cathode cup. The adjustment fixture 112 also includes the bore 115 for receiving the set screw 114 for securing the adjustment fixture 112 to the micrometer, and the bore 123 for receiving set screw 122 for securing the adjustment assembly relative to a filament feedthrough sleeve. An optional view port 124 is included in a sidewall of the second section 118 for allowing the operator to assess contact between the pushrod 106 of the micrometer 102 and the filament post.

Figure 9:
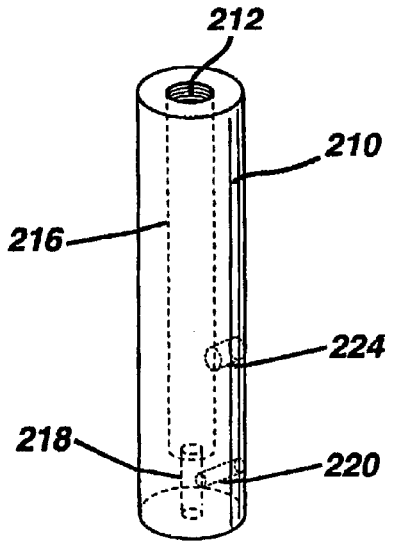
FIG. 9 is an illustration of another fixture, as embodied by the invention.
Figure 10:
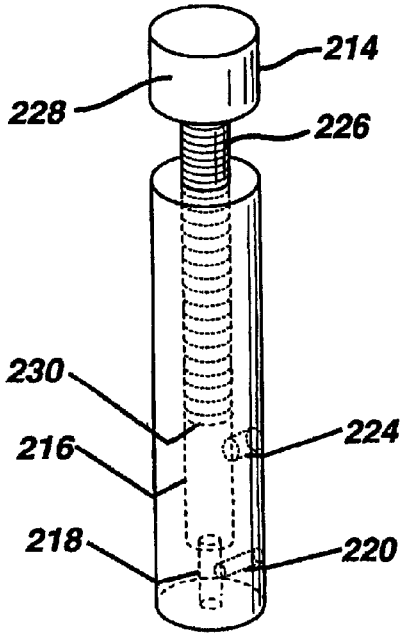
FIG. 10 is an illustration of another filament set height adjustment tool, as embodied by the invention.

With reference to FIGS. 9 and 10, an alternative configuration of a filament adjustment tool, as embodied by the invention, is illustrated. In FIG. 9, a cylindrical fixture 210 includes a central bore 212, with the central bore 212 comprising a threaded interior wall for receiving an adjustment bolt 214, as illustrated in FIG. 10. The central bore 212 comprises a first section 216 having a first diameter and a second section 218 having a second diameter, which is generally less than that of the first diameter. A bore 220 intersects the second section 218 in which the bore 220 can receive a set screw 222 (similar to the set screw 122) for securing the fixture 210 with respect to a filament feedthrough sleeve. A view port 224 is provided to allow the operator to verify the contact between the bolt 214 and a filament post extending from the filament feedthrough sleeve.

As illustrated in FIG. 10, the adjustment bolt 214 comprises a threaded pushrod 226, which engages the central bore 212 of the fixture and is movable therein in an axial direction in response to rotation of a head 228 of the bolt 214. The fixture 210 is selectively secured to, for example, but not limited to, the filament feedthrough sleeve of a cathode cup by way of a set screw received in the bore 220, with a portion of the filament feedthrough sleeve and the filament post of the cathode cup extending into the first section 216. Once secured thereto, rotation of the bolt 214 causes the end 230 of the rod 226 to contact the filament lead. Continued rotation of the bolt 214 causes the post to be moved relative to the filament feedthrough sleeve, thus allowing the filament set height to be adjusted within the cathode cup. This process is generally similar to the above-described embodiment, and reference is made thereto for a description of the process.

In the description, the terms are provided with their normal meaning to a person of ordinary skill in the art, unless otherwise specified. For example, the terms "substantially" and "generally" are relative terms with variances as understood in the art.

While various embodiments are described herein, it will be appreciated from the specification that various combinations of elements, variations or improvements therein may be made by those skilled in the art, and are within the scope of the invention.

What is claimed is:

1. A method for adjusting a filament within a cathode of an x-ray tube to a desired filament set height, the method comprising:

providing a cathode cup of an x-ray tube, the cathode cup comprising at least two feedthroughs extending therethrough;

inserting a filament lead through the at least two bores to a position below a desired filament set height;

determining an filament set height adjustment distance in which the filament set height adjustment is generally equal to a difference between the actual filament set height and the desired filament set height;

contacting an end of said filament post with an adjustment tool; and moving at least one of the post and adjustment tool with respect to each other a distance substantially equal to said filament set height adjustment distance, thereby positioning the filament at the predetermined filament set height.

2. The method according to claim 1, the method further comprising the step of inserting and securing a filament lead tube.

3. The method according to claim 2, wherein the step of insertion comprises extending the post from an end of the filament lead tube.

4. The method according to claim 3, the method further comprising the step of frictionally maintaining the lead within the filament lead tube.

5. The method according to claim 4, wherein the method further comprises crimping the filament lead to frictionally maintain the lead within the filament lead tube.

6. The method according to claim 4, the method further comprising the step of selectively securing the adjustment tool to the feedthrough sleeve tube.

7. The method according to claim 1, wherein the adjustment tool comprises a fixture, the fixture comprising a bore having a first open end and a second open end with the filament feedthrough sleeve tube being received in the second open end, and a calibrator being received in the first open end.

8. The method according to claim 7, wherein the second open end includes a clamp for selectively securing the fixture to the filament lead tube.

9. The method according to claim 7, wherein the calibrator comprises a micrometer, the micrometer being secured within the first open end of the fixture, the micrometer comprising a pushrod extending into the bore toward the second open end for contacting the lead.

10. The method according to claim 9, wherein a readout of the micrometer is noted when the rod makes contact with the lead of the filament.

11. The method according to claim 9, wherein the micrometer is adjusted so as to displace the pushrod along the axis of the filament post by a distance equal to the filament set height adjustment distance.

12. A device for adjusting a filament set height in a cathode, the device comprising:

a fixture comprising a central bore having a first open end and a second open end;

a calibrator received in the first open end of the fixture; and a device to secure the second open end of the fixture to a portion of the cathode such that a filament post extends through the second open end;

wherein the calibrator is capable of being brought into contact with an end of the filament post.

13. The device of claim 12, wherein the second open end of the fixture is secured to a filament feedthrough sleeve of the cathode.

14. The device of claim 12, wherein the calibrator is displaceable along the filament post axis.

15. The device of claim 12, wherein the central bore comprises a first section adjacent the first open end and a second section adjacent the second open end with a diameter of the first section being greater than a diameter of the second section.

16. The device of claim 15, wherein the filament post extends into the first section from a filament feedthrough sleeve and the latter is selectively secured in the second section.

17. The device of claim 15, wherein the calibrator comprises a threaded connector to allow attachment to the first section of the fixture.

18. The device of claim 16, wherein the calibrator comprises a micrometer.

19. The device of claim 15, wherein the first section comprises an intermediate section between the first open end and the second section.

20. The device of claim 19, wherein the calibrator comprises a rod axially extending into the intermediate section.

21. The device of claim 20, wherein the filament lead extends into the intermediate section from the filament lead tube selectively secured in the second section.

22. An adjustment apparatus for adjusting an x-ray tube filament, the adjustment apparatus comprises:

a fixture comprising a central bore having a first open end and a second open end;

means, being brought into contact with an end of the filament post, for adjusting the set height position of the filament, the means being received in the first open end of the fixture and having its axis of translation collinear with the filament post; and means adjacent the second open end for securing the fixture to a portion of the cathode such that a filament post extends through the second opened end;

wherein the means for adjusting is capable of being brought into contact with an end of the filament post and adjusting the set height position of the filament.

* * * * *